US006811475B2

(12) United States Patent
Riley

(10) Patent No.: US 6,811,475 B2
(45) Date of Patent: Nov. 2, 2004

(54) SURFACE FINISHING PAD

(75) Inventor: James Francis Riley, Ridgehaven (AU)

(73) Assignee: Susan Gail McNair, Ridgehaven (AU)

( * ) Notice: Subject to any disclaimer, the term of this patent is extended or adjusted under 35 U.S.C. 154(b) by 12 days.

(21) Appl. No.: 10/220,581

(22) PCT Filed: Mar. 23, 2001

(86) PCT No.: PCT/AU01/00321

§ 371 (c)(1),
(2), (4) Date: Nov. 4, 2002

(87) PCT Pub. No.: WO01/72469

PCT Pub. Date: Oct. 4, 2001

(65) Prior Publication Data

US 2003/0139125 A1 Jul. 24, 2003

(30) Foreign Application Priority Data

Mar. 27, 2000 (AU) ..... PQ6523

(51) Int. Cl.[7] ..... B24B 23/02

(52) U.S. Cl. ..... 451/359; 451/353; 15/418; D8/61; D8/62

(58) Field of Search ..... 451/353, 354, 451/359, 456, 344, 956, 295, 520–522; 15/418; D8/61, 62, 63–70

(56) References Cited

U.S. PATENT DOCUMENTS

| | | | | | |
|---|---|---|---|---|---|
| 4,328,645 | A | * | 5/1982 | Sauer | 451/359 |
| 5,138,735 | A | * | 8/1992 | Kusz et al. | 15/97.1 |
| 5,150,546 | A | * | 9/1992 | Tucker | 451/342 |
| 5,389,032 | A | * | 2/1995 | Beardsley | 451/359 |
| 5,531,639 | A | * | 7/1996 | Catalfamo | 451/456 |
| 5,620,364 | A | * | 4/1997 | Torrance et al. | 451/359 |
| 6,027,399 | A | * | 2/2000 | Stewart | 451/353 |
| D444,688 | S | * | 7/2001 | Boehler | D8/62 |
| 6,523,214 | B1 | * | 2/2003 | Kaiser | 15/230 |

FOREIGN PATENT DOCUMENTS

| | | |
|---|---|---|
| EP | 0361505 A | 4/1990 |
| EP | 0619165 A | 10/1994 |
| EP | 0914907 A | 5/1999 |
| WO | 99/58297 A | 11/1999 |

* cited by examiner

*Primary Examiner*—Joseph J. Hail, III
*Assistant Examiner*—Anthony Ojini
(74) *Attorney, Agent, or Firm*—R. Neil Sudol; Henry D. Coleman; William J. Sapone

(57) ABSTRACT

Disclosed is a surface finishing pad for fitting to a base plate of a surface-finishing machine. The Surface finishing pad includes a retaining disc for attachment to the base plate. The retaining disc contains engaging means for engaging a mounting pad onto which one or more surface finishing discs may be attached. The mounting pad includes retaining disc engagement means complementary to the mounting pad engagement means, wherein an interference fit between the retaining disc and mounting pad engagement means provides for the mounting pad to be releasably fitted on to the retaining disc. In use, the mounting pad is retained on the retaining disc as a result of the interference fit between the retaining disc and mounting pad engagement means.

26 Claims, 3 Drawing Sheets

SURFACE FINISHING PAD

The present invention relates to a surface finishing pad for use with a surface finishing machine such as a sander, burnisher or polisher.

BACKGROUND OF THE INVENTION

Surface finishing machines are commonly used for sanding, burnishing or polishing wood, stone, metal or plastics surfaces. These machines typically contain a surface finishing pad which may be a sanding disc, a microfine finishing disc, buffing disc, or the like. In most instances, movement of the surface finishing pad is reciprocally driven by a motor which may have a backing plate fitted thereto so that the surface finishing pad can be operably attached to the backing plate. Known surface finishing machines may drive the surface finishing pad in a random orbital rotational motion, or a linear reciprocating motion.

For a given job the user of the surface finishing machine may require a range of surface finishing pads of different properties. Thus, in the case of a sanding job the user may need to use a range of surface finishing pads having sanding discs ranging from coarse through to very fine. This may require the user to spend a significant amount of time changing the surface finishing pads. It is known to attach surface finishing pads to a backing plate using an adhesive. It is also known to attach surface finishing pads to a backing plate using a hook and loop fastener such as VELCRO™ which allows the pads to be interchanged. However depending on the job at hand, it is often found that when a hook and loop fastener is used the surface finishing pads tend to come loose or tear and/or the application of excess pressure can result in the pad moving with respect to, or coming loose from, the backing plate.

In many instances the user may also require surface finishing pads of different configuration or dimension depending on the job at hand. For this reason the user may have a number of machines having different shaped or sized backing plates.

At least one embodiment of the present invention provides a surface finishing pad which has a mounting pad onto which commercially available sanding discs or the like can be fitted and the mounting pad can be releasably attached to a backing plate of a surface finishing machine so that the mounting pad can be readily removed and replaced.

For the purposes of this specification the word "comprising" means "including but not limited to", and the word "comprises" has a corresponding meaning. Also a reference within this specification to a document is not to be taken as an admission that the disclosure therein constitutes common general knowledge in Australia.

SUMMARY OF THE INVENTION

In a first aspect, the invention could be said to reside in a surface finishing pad for fitting to a base plate of a surface finishing machine, the surface finishing pad including a retaining disc for attachment to the base plate, the retaining disc containing engaging means for engaging a mounting pad onto which one or more surface finishing discs may be attached, said mounting pad including retaining disc engagement means complementary to the mounting pad engagement means, wherein an interference fit between the retaining disc and mounting pad engagement means provides for the mounting pad to be releasably fitted on to the retaining disc, such that, in use, the mounting pad is retained on the retaining disc.

In one form of the invention the retaining disc and mounting pad engagement means are complementary shaped peg and aperture wherein the dimensions of the aperture are slightly less than those of the peg so that the peg can be fitted into the aperture and can provide an interference fit therewith.

In the following discussion the invention will be described in respect of a retaining disc having a peg extending from one face and a mounting pad having a complementary aperture formed therein. However it will be appreciated that the invention also contemplates a surface finishing pad in which the retaining disc has an aperture into which a peg extending from a face of the mounting pad can be inserted so as to provide an interference fit therewith.

The peg and aperture may be circular, square or any other suitable shape. Preferably the peg and aperture are circular. In the case of a circular peg and aperture it may be necessary to also provide a rotation inhibition means to inhibit relative rotational movement between the retaining disc and the mounting pad. In the case of a square peg and aperture a rotation inhibition means will not normally be necessary because the square aperture will not allow rotation around the square peg.

The retaining disc may contain more than one peg extending from a surface thereof, and the mounting pad may have a corresponding number of complementary apertures formed therein such that the apertures in the mounting pad may be aligned with the pegs and then pushed over the pegs.

The mounting pad may be a laminate of two or more layers. In one specific form the mounting pad includes a first layer of resilient plastics for attachment to the retaining disc, a second layer of compressible material such as foam rubber, and a final layer of plastics onto which one or more surface finishing discs may be attached.

In one form of the invention the first layer of resilient plastics may be the only part of the mounting pad that forms an interference fit with the peg. Thus the aperture in the second and final layers may be of the same diameter or larger diameter than the peg, and the aperture in the first layer may be of slightly smaller diameter than the peg. This embodiment provides for ease of use in that it is only the relatively thin first layer that provides an interference fit and this therefore makes the mounting pad easier to fit than when the whole thickness of the mounting pad provides an interference fit with the peg.

Preferably the length of a peg extending from the surface of the retaining disc is less than or equivalent to the thickness of the mounting pad so that the peg does not protrude from a working surface of the mounting pad onto which the surface finishing discs are attached. It will be understood that when the first layer provides the primary interference fit with the peg the length of the peg need only be sufficient for the first layer to engage the peg.

The peg may be hollow so that a dust extraction means can be attached thereto and the hollow peg can act as a duct for removal of dust and the like from the surface as it is being finished. Suitable dust extraction means are known to those skilled in the art and are also discussed in PCT/AU00/00212. When dust extraction means are used it is preferable that the length of the peg is less than the thickness of the mounting pad. Thus, when a vacuum is applied the peg may provide a negative pressure so that the part of the mounting pad that extends past the peg may be influenced by the vacuum such that it assists in retaining the mounting pad on the retaining disc.

The peg may have a circumferential groove formed on an outer surface such that the diameter in the groove is about the same as the diameter of the aperture in the mounting pad. In this way the mounting pad may be snap fitted over the peg and into the groove in the peg. The width of the groove may be the same as or slightly greater than the thickness of the first layer of the mounting pad so that the first layer snap fits into the groove when the mounting pad is correctly fitted.

The peg may also be tapered outwardly from the surface of the retaining disc. The taper may be such that the diameter of the peg at the smaller diameter end adjacent the surface of the retaining disc may be about the same as the diameter of the aperture in the mounting pad, whilst the diameter of the peg at the larger end may be slightly greater than the diameter of the aperture so that the mounting pad can be fitted over the peg and the direction and angle of the taper can assist in forcing the mounting pad toward the retaining disc.

The surface finishing pad may be used on any standard surface finishing machine by fixing the retaining disc to the backing plate of the machine. Thus, the retaining disc and mounting pad may be sold together or separately and can be retrofitted to standard orbital sanding machines or the like. Alternatively, the surface finishing pad may be used on the surface finishing machine described in PCT/AU00/00212.

The surface finishing discs that are fitted onto the mounting pad may be any of the commercially available discs such as sanding discs, buffing discs and the like.

It will be appreciated that, in a second aspect, the invention also encompasses a surface finishing disc having the surface finishing pad of the first aspect of the invention attached thereto, and for use on a surface finishing machine having the retaining disc of the first aspect of the invention fitted thereto.

In a third aspect the invention could be said to reside in a surface finishing machine having the surface finishing pad of the first aspect of the invention fitted thereto.

BRIEF DESCRIPTION OF THE DRAWINGS

To assist in the understanding of the invention preferred embodiments will now be described with reference to the accompanying drawings.

DETAILED DESCRIPTION OF THE INVENTION

Figure 1:
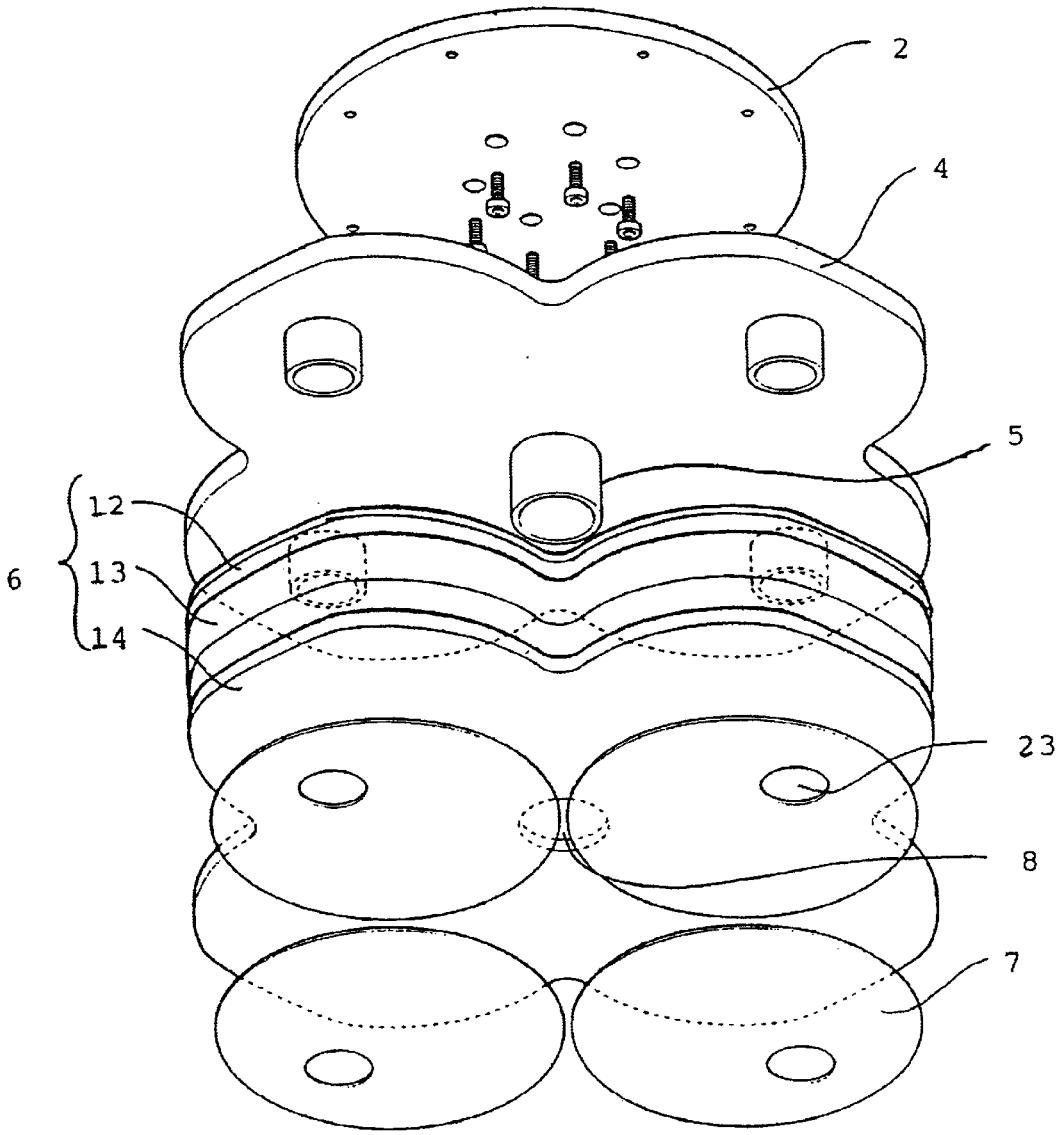
FIG. 1 is a sketch of the disassembled view of a finishing pad.
Figure 2:
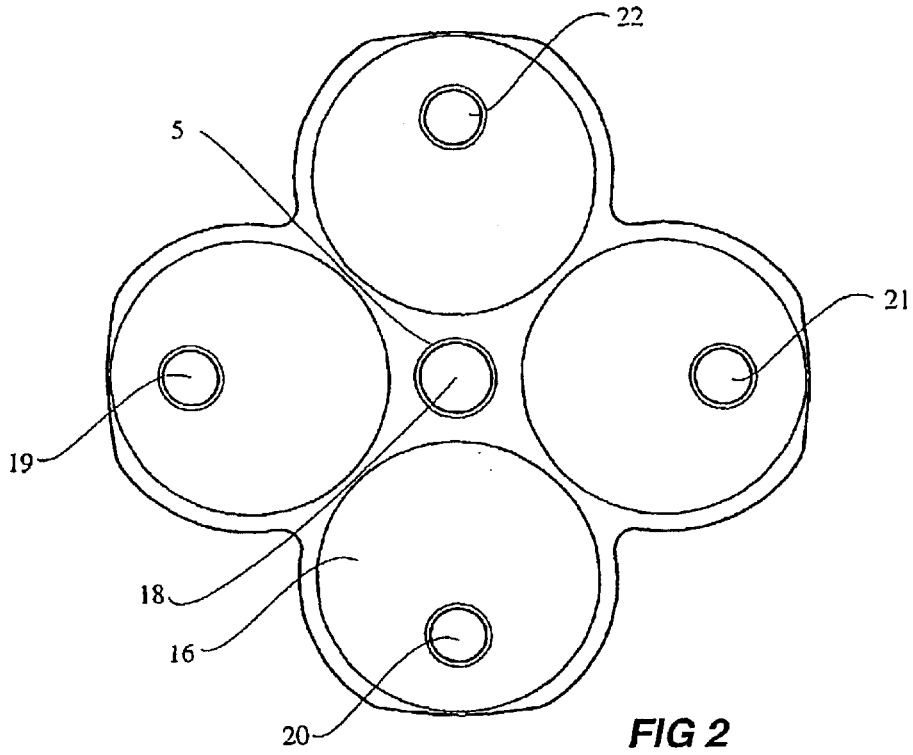
FIG. 2 is a plan view sketch of a mounting pad.
Figure 3:
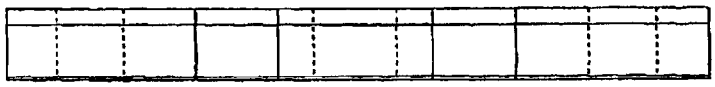
FIG. 3 is a side view sketch of the mounting pad shown in FIG. 2.
Figure 4:
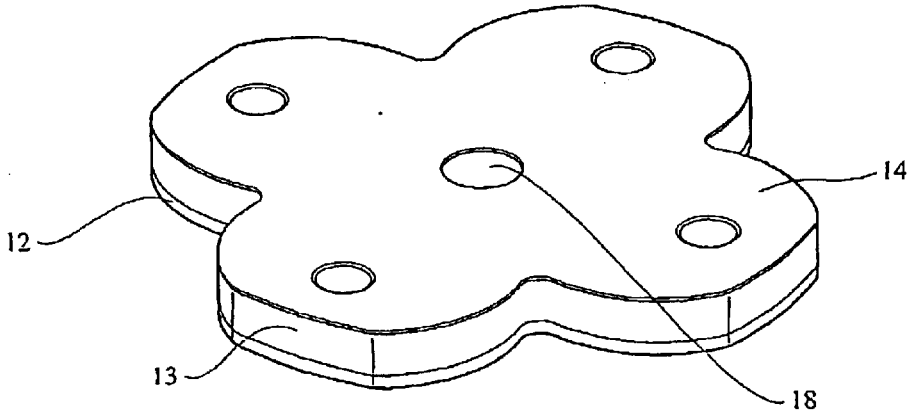
FIG. 4 is a perspective view sketch of the mounting pad shown in FIG. 2.
Figure 5:
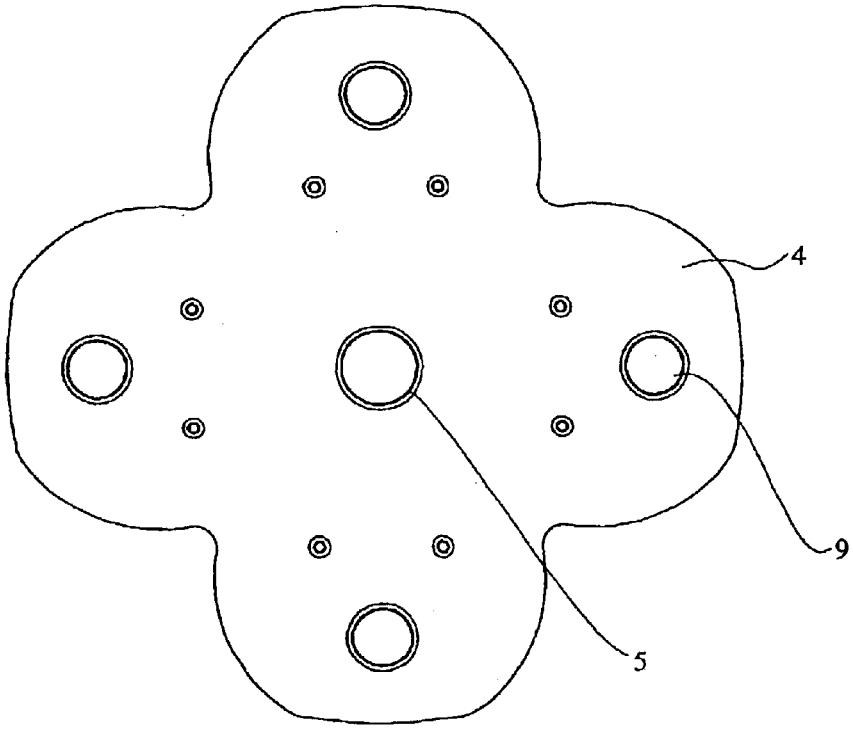
FIG. 5 is a plan view sketch of a retaining disc.
Figure 6:
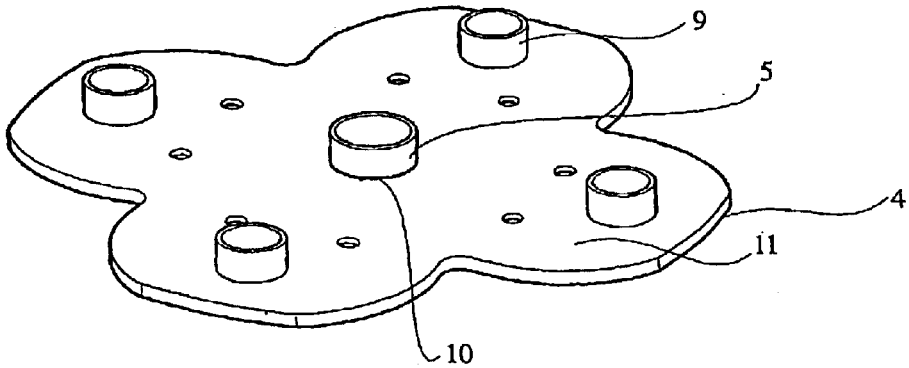
FIG. 6 is a perspective view sketch of the retaining disc shown in FIG. 5; and, FIG. 7 is a sketch of the central peg shown in FIG. 6.
Figure 7:
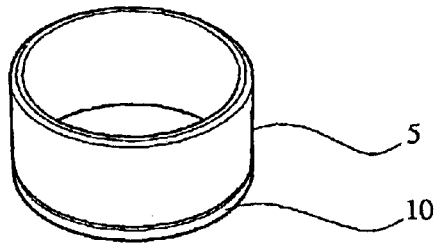

It will be appreciated that the accompanying drawings are sketches and not engineering design drawings. The intention is to assist understanding of the invention and so perspective or features may be distorted or omitted for clarity. Throughout the drawings the same reference numeral will be used to refer to the same or similar feature.

The drawings show a surface, finishing pad (1) for fitting to a base plate (2) of a surface finishing machine (not shown). The surface finishing pad includes a retaining disc (4) for attachment to the base plate (2). The retaining disc contains engaging means in the form of a peg (5) for engaging a mounting pad (6) onto which one or more surface finishing discs (7) may be attached. The mounting pad (6) contains retaining disc engagement means in the form of an aperture (8) which is complementary in shape to the peg (5). An interference fit between the peg (5) and aperture (8) provides for the mounting pad to be releasably fitted to the retaining disc, such that, in use, the mounting pad is retained on the retaining disc.

The interference fit between peg and aperture are the only means by which the mounting pad is held in place on the retaining disc and this thereby provides for easy and rapid fitting and removal of sanding pads. Therefore in the situation where a user requires a variety of mounted surface finishing pads for a particular job they can be readily interchanged without having to resort to the use of tools to unscrew the surface finishing pad, for example.

The retaining disc (4) is mounted by bolts to the base plate. The retaining disc is a 9 mm thick fibre board disc which in plan view is not circular. It is quite rigid and so provides a firm backing to the mounting pad. The diameter of the base plate (2) is less than that of the fibre board disc to reduce overall weight. The fibre board disc acts to extend the diameter of the base plate without adding significant weight to the machine. The fibre bard disc may also be different shape to the base plate and therefore a range of differently shaped surface finishing pads could be fitted to one shape of base plate.

Glued to the fibre board disc are four mounting area pegs (one shown as 9) and a central peg (5) all made of P.V.C. cylindrical tubing approximately 33 mm in diameter. The mounting area pegs provide rotation inhibition means for the mounting pad as well as providing conduits for vacuum ports through which dust may be extracted. Thus the mounting pad and retaining disc have aligned apertures therethrough which form vacuum ports for communication with a vacuum extraction system, the details of which may be found in PCT/AU00/00212.

The central peg (5) has an external circumferential groove (10) of approximately 0.5 mm depth and 2 mm width. This groove is located so that it is approximately level with but slightly spaced from the surface (11) from which the pegs project. This groove forms part of the engaging means for securing the mounting pad to the retaining disc.

The mounting pad (6) is of layer construction having a first layer (12) of urethane approximately 6 mm thick, a second layer (13) of foam rubber of approximately 9 mm thickness, and a final layer being a P.V.C. plate (14) of approximately 1 mm thickness. These layers are glued together to make a laminated structure.

All the layers of the mounting pad include apertures to receive the pegs projecting from the fibre board disc. The diameter of the aperture of the first layer to receive the central peg is slightly smaller than the diameter of the peg, approximately 32 mm compared with approximately 33 mm, so forming a circular detent (15). The first layer (12) is sufficiently resilient to flex under manual pressure of fitting the mounting pad to allow the central peg to be received and when against the retaining disc the first layer clicks into the groove (10). This prevents unintentional separation of the retaining disc and the mounting pad whilst allowing easy fitting. The four mounting area pegs register the mounting pad relative to the retaining disc. The first layer is also flexible enough to allow for intentional removal of the mounting pad by an operator.

Being able to change the mounting pad allows a number of mounting pads to be prepared and interchanged as required before requiring new surface finishing pads to be fitted. Also, changing mounting pads permits changing from one grade of finishing pad to another including going from sanding to buffing.

The final layer (14) of the mounting pad has four radially spaced finishing disc mounting areas (one shown as 16) spaced about its centre each 180 mm in diameter. The disc mounting areas are circular in shape and surface finishing discs can be mounted thereto by use of hook and loop means fastener, as commonly known under the trade mark VELCRO. The disc mounting areas are proud of the mounting pad by 3 mm interspaced by web portions (17) which are approximately 3 mm thick.

To the disc mounting areas may be mounted modified standard 180 mm (6 inch) discs that are commonly available within Australia and in at least some overseas countries. These discs, it is intended, will be available with an aperture (23) therethough to align with the vacuum port within the mounting area. Alternatively, it is a relatively simple matter to cut a suitable aperture through a prior known disc. Such apertures are not required with polishing or buffing discs where dust is not created to any serious extent.

Depending upon the application and whether dust is created, the surface finishing pad has a dust extraction aperture (18). The dust extraction aperture aligns with the vacuum port within the respective mounting area. The surface finishing disc may be a modified previously known and commercially available surface finishing disc, the modification being the cutting of the dust extraction aperture. Through the mounting pad are vacuum ports (18, 19, 20, 21 and 22) defined by the pegs.

The peg (5) is hollow so that a dust extraction means can be attached thereto and the hollow peg can act as a duct for removal of dust and the like from the surface as it is being finished. Suitable dust extraction means are known to those skilled in the art and are also discussed in PCT/AU00/00212. The length of the peg is less than the thickness of the mounting pad and in this way when a vacuum is applied the peg may provide a negative pressure so that the part of the mounting pad that extends past the peg may be influenced by the vacuum such that it assists in retaining the mounting pad on the retaining disc.

Other variations to the just described embodiment will be apparent to the skilled addressee including the provision of mounting areas spaced about two or more rings about the centre of the mounting pad thereby allowing a greater area to be finished at any time.

It will be appreciated that this disclosure is not intended to limit the invention to the preferred embodiment or details thereof. It is intended to give an overview of the invention as conceived and other embodiments will be apparent to the skilled addressee all of which fall within the spirit of the invention.

What is claimed is:

1. A surface finishing pad for fitting to a base plate of a surface finishing machine, the surface finishing pad including a retaining disc for attachment to the base plate, the surface finishing pad further including a mounting pad for attachment of one or more surface finishing discs, one of the retaining disc and the mounting pad having at least one peg, the other of the retaining disc and the mounting pad having at least one aperture with a shape complementary to that of the peg, the aperture having dimensions slightly less than dimensions of the peg so that the peg fits into the aperture in an interference fit therewith to thereby reversibly fit the mounting pad onto the retaining disc, such that, in use, the mounting pad is retained on the retaining disc.

2. A surface finishing pad as in claim 1 wherein the peg extends from one face of the retaining disc and the aperture is formed in the mounting pad.

3. A surface finishing pad as in claim 2 wherein the peg and aperture are circular.

4. A surface finishing pad as in claim 3 wherein the retaining disc contains more than one peg extending from a surface thereof, and the mounting pad has a corresponding number of complementary apertures formed therein, the apertures being alignable with respective ones of the pegs, the pegs being insertable into respective ones of the apertures.

5. A surface finishing pad as in claim 3 wherein the mounting pad is a laminate of two or more layers.

6. A surface finishing pad as in claim 5 wherein the mounting pad includes a first layer of resilient plastics for attachment to the retaining disc, a second layer of compressible material, and a final layer of plastics for attachment of one or more surface finishing discs.

7. A surface finishing pad as in claim 6 wherein the aperture extends through the first layer, the second layers and the final layer and wherein the aperture in the second and final layers is of the same diameter or larger diameter than the peg, and the aperture in the first layer is of slightly smaller diameter than the peg so that only the first layer provides an interference fit with the peg.

8. A surface finishing pad as in claim 6 wherein the peg has a circumferential groove formed on an outer surface such that the diameter in the groove is about the same as the diameter of the aperture in the mounting pad and the mounting pad can be snap fitted over the peg and into the groove in the peg.

9. A surface finishing pad as in claim 8 wherein the width of the groove is the same as or slightly greater than the thickness of the first layer of the mounting pad so that the first layer snap fits into the groove when the mounting pad is correctly fitted.

10. A surface finishing pad as in claim 8 wherein the length of the peg extending from the surface of the retaining disc is less than or equivalent to the thickness of the mounting pad so that the peg does not protrude from a working surface of the mounting pad onto which the surface finishing discs are attached.

11. A surface finishing pad as in claim 10 wherein the peg is hollow so that a dust extraction means can be attached thereto and the hollow peg can act as a duct for removal of dust from a surface being finished.

12. A surface finishing pad as in claim 11 wherein the length of the peg is less than the thickness of the mounting pad so that when a vacuum is applied the peg provides a negative pressure and part of the mounting pad that extends past the peg is acted on by the vacuum to assist in retaining the mounting pad on the retaining disc.

13. A surface finishing pad as in claim 2 wherein the peg is tapered outwardly from a surface of the retaining disc and the taper is such that the diameter of the peg at the smaller diameter end adjacent the surface of the retaining disc is about the same as the diameter of the aperture in the mounting pad, whilst the diameter of the peg at the larger end is slightly greater than the diameter of the aperture so that the mounting pad can be fitted over the peg and the direction and angle of the taper assists in forcing the mounting pad toward the retaining disc.

14. A surface finishing pad as in claim 1 wherein the retaining disc is fixed to the backing plate of a standard surface finishing machine.

15. A surface finishing machine comprising a base plate and a surface finishing pad, the surface finishing pad including a retaining disc for attachment to the base plate, the surface finishing pad further including a mounting pad for attachment of one or more surface finishing discs, one of the retaining disc and the mounting pad having at least one peg, the other of the retaining disc and the mounting pad having at least one aperture with a shape complementary to that of the peg, the aperture having dimensions slightly less than dimensions of the peg so that the peg fits into the aperture in an interference fit therewith to thereby reversibly fit the mounting pad onto the retaining disc, such that, in use, the mounting pad is retained on the retaining disc.

16. A surface finishing machine as in claim 15 wherein the peg extends from one face of the retaining disc and the aperture is formed in the mounting pad.

17. A surface finishing machine as in claim 16 wherein the peg and aperture are circular.

18. A surface finishing machine as in claim 17 wherein the retaining disc contains more than one peg extending from a surface thereof, and the mounting pad has a corresponding number of complementary apertures formed therein, the apertures in the mounting pad being alignable with respective ones of the pegs, the pegs being insertable into respective ones of the apertures.

19. A surface finishing machine as in claim 17 wherein the mounting pad is a laminate of two or more layers.

20. A surface finishing machine as in claim 19 wherein the mounting pad includes a first layer of resilient plastics for attachment to the retaining disc, a second layer of compressible material, and a final layer of plastics for attachment of one or more surface finishing discs.

21. A surface finishing machine as in claim 20 wherein the aperture extends through the first layer, the second layers and the final layer and wherein the aperture in the second and final layers is of the same diameter or larger diameter than the peg, and the aperture in the first layer is of slightly smaller diameter than the peg so that only the relatively thin first layer provides an interference fit with the peg.

22. A surface finishing machine as in claim 20 wherein the peg has a circumferential groove formed on an outer surface such that the diameter in the groove is about the same as the diameter of the aperture in the mounting pad and the mounting pad can be snap fitted over the peg and into the groove in the peg.

23. A surface finishing machine as in claim 22 wherein the width of the groove is the same as or slightly greater than the thickness of the first layer of the mounting pad so that the first layer snap fits into the groove when the mounting pad is correctly fitted.

24. A surface finishing machine as in claim 22 wherein the length of the peg extending from the surface of the retaining disc is less than or equivalent to the thickness of the mounting pad so that the peg does not protrude from a working surface of the mounting pad onto which the surface finishing discs are attached.

25. A surface finishing machine as in claim 24 wherein the peg is hollow so that a dust extraction means can be attached thereto and the hollow peg can act as a duct for removal of dust from a surface being finished.

26. A surface finishing machine as in claim 25 wherein the length of the peg is less than the thickness of the mounting pad so that when a vacuum is applied the peg provide a negative pressure and part of the mounting pad that extends past the peg is acted on by the vacuum to assist in retaining the mounting pad on the retaining disc.

* * * * *